US007909030B2

(12) United States Patent
Christianson

(10) Patent No.: US 7,909,030 B2
(45) Date of Patent: Mar. 22, 2011

(54) ELLIPTICAL PURGE VALVE FOR SNORKELS

(76) Inventor: Tony Christianson, Yosemite, CA (US)

( * ) Notice: Subject to any disclaimer, the term of this patent is extended or adjusted under 35 U.S.C. 154(b) by 1364 days.

(21) Appl. No.: 11/241,619

(22) Filed: Sep. 27, 2005

(65) Prior Publication Data

US 2007/0068519 A1 Mar. 29, 2007

(51) Int. Cl.

| | |
|---|---|
| ***B63C 11/16*** | (2006.01) |
| ***B63C 11/02*** | (2006.01) |
| ***B63C 11/10*** | (2006.01) |
| ***A62B 18/08*** | (2006.01) |
| ***A62B 18/10*** | (2006.01) |
| ***A62B 17/00*** | (2006.01) |

(52) U.S. Cl. ..... 128/201.11; 128/201.26; 128/201.27; 128/201.28; 128/201.29; 128/200.29; 128/206.29; 405/186; 405/187

(58) Field of Classification Search ..... 128/201.29, 128/200.29, 206.29, 912, 201.11, 201.26, 128/201.27, 201.28; 405/186, 187; 181/27, 127

See application file for complete search history.

(56) References Cited

U.S. PATENT DOCUMENTS

| | | | | |
|---|---|---|---|---|
| 4,872,453 | A * | 10/1989 | Christianson | 128/201.11 |
| 6,129,081 | A * | 10/2000 | Wu | 128/201.11 |
| 6,276,362 | B1 * | 8/2001 | Chen-Lieh | 128/201.11 |
| 7,047,965 | B1 * | 5/2006 | Ball | 128/201.11 |
| 7,163,012 | B2 * | 1/2007 | Delphia | 128/201.11 |

* cited by examiner

*Primary Examiner* — Patricia M Bianco
*Assistant Examiner* — Nihir Patel

(57) ABSTRACT

The instant invention incorporates an asymmetrical purge valve tilted to fit within the confines of a chamber having a substantially elliptical cross-section. The elliptical cross-section is oriented to minimize the frontal area presented in the direction of swimming movement. The reduced cross-section results in a corresponding reduction of drag when the diver is swimming underwater.

17 Claims, 4 Drawing Sheets

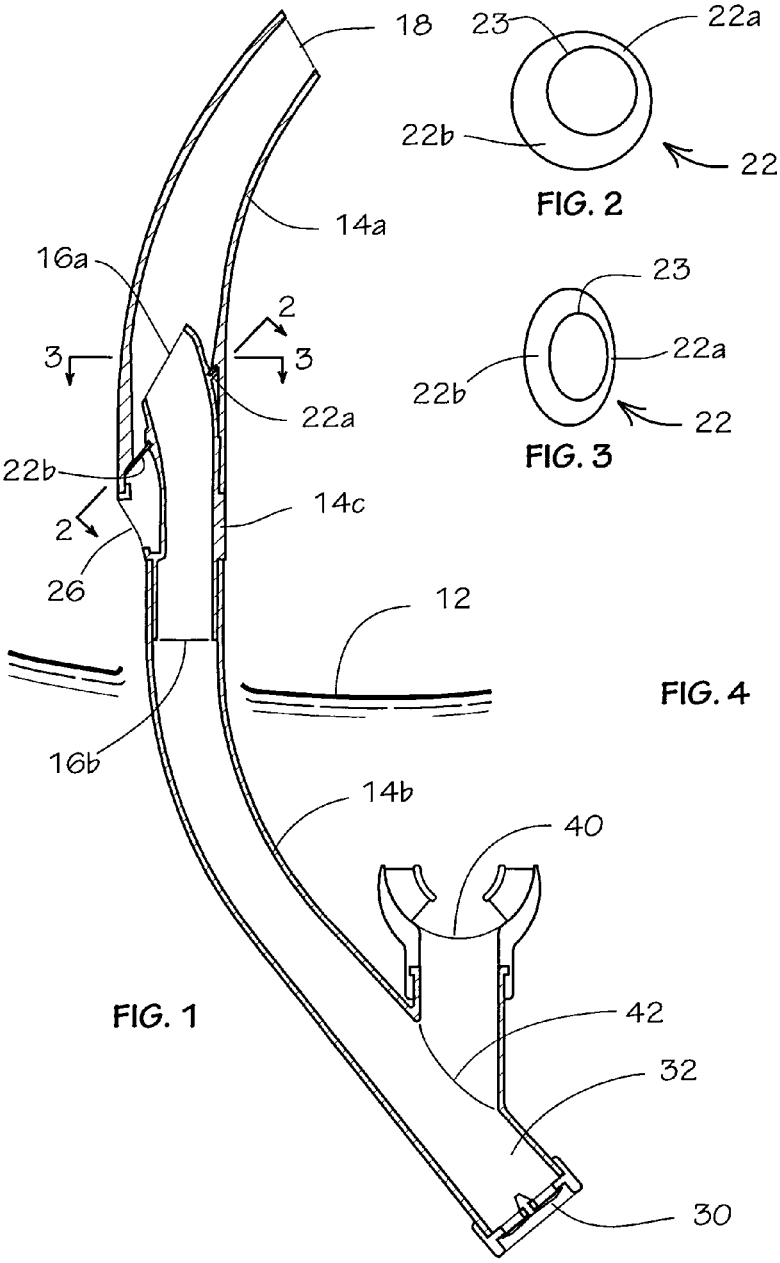
FIG. 1
FIG. 2
FIG. 3
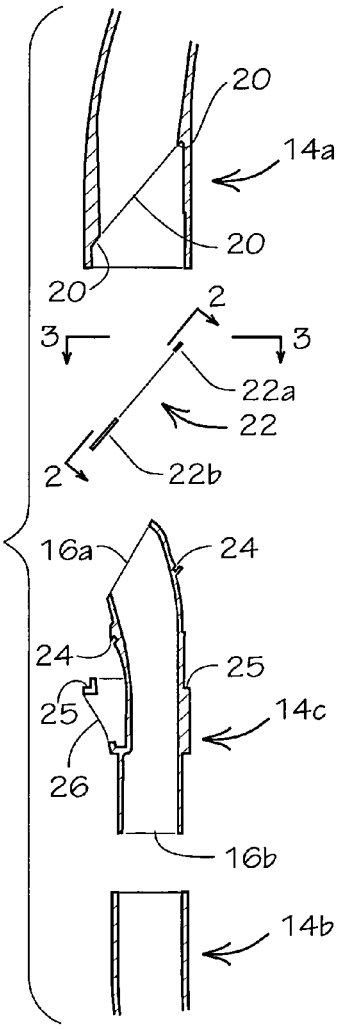
FIG. 4

ELLIPTICAL PURGE VALVE FOR SNORKELS

BACKGROUND OF THE INVENTION

1. Field of the Invention

The present invention is generally related to snorkels used by skin divers and swimmers. More particularly, this invention is related to devices that help purge water from a snorkel.

2. Description of the Prior Art

Skin divers and swimmers use the snorkel as a means to breathe while swimming face down on the water surface. The snorkel functions as a conduit between the diver's mouth and the overhead air (hereinafter "skin diver", "swimmer" and "diver" will be used interchangeably). Typically, the open end of the snorkel conduit extends a short distance above the water surface. Occasionally, due to swimming movements or wave action, small amounts of water flow or splash into the open end of the snorkel and partially floods the conduit. An experienced skin diver can sense when water enters the snorkel and responds by immediately stopping inhalation. Respiration is resumed after the snorkel has been purged of water. Inexperienced skin divers find occasional flooding especially troublesome because, undetected, water can be inhaled resulting in coughing and extreme discomfort.

Water will also flood the snorkel when the swimmer deliberately dives below the water surface. The snorkel conduit will be completely flooded with water when the swimmer returns to the surface. When the open end of the snorkel is again above the water surface, the flooded conduit is purged for respiration by exhaling an explosive blast of air into the mouthpiece.

Surface tension forms the purging blast of air into a bubble that spans the cross section of the snorkel conduit. Pressure within the bubble expands the bubble toward the open end of the conduit. As the leading surface of the bubble moves away from the mouthpiece, the bulk of the water within the conduit is pushed ahead of the bubble and out the open end.

The purging bubble of air will slip past water that adheres to the inside surface of the conduit. After the purging air bubble is spent, residual water will flow down the inside surface toward the mouthpiece. Also, water which splashes into the open end of the snorkel conduit due to swimming movements or wave action will typically strike and adhere to the inside surface of the conduit and thereafter flow toward the mouthpiece. Water accumulates at the lowermost portion of the snorkel conduit, typically adjacent the mouthpiece, and can soon obstruct the conduit. Unless the conduit is completely blocked, a slow and cautious inhalation is possible after which another purging exhalation can be made.

The respiratory effort needed to purge a snorkel is significant. Some skin divers and swimmers lack the respiratory strength needed to completely purge a flooded snorkel with a single exhalation, and must repeat the purging procedure several times. Also, water will sometimes enter the snorkel just as the swimmer has completed an exhalation, leaving very little air in the lungs to satisfactorily complete a purge.

A popular solution places an externally directed purge valve in the snorkel conduit at a location near the snorkel mouthpiece. Water in a flooded conduit that extends above the ambient water surface will drain through a purge valve. A purge valve will drain the snorkel conduit until the water level within the conduit matches the ambient water level. Theoretically, because the total volume of water in the flooded snorkel is reduced by the initial flow through the purge valve, the respiratory effort required to purge the remaining water is also reduced.

Unfortunately, a purge valve also provides an alternate path for forcefully exhaled air. A purge valve will quickly and wastefully dissipate the explosive blast of purging air when the purge valve is located close to the mouthpiece. One solution to this problem places a purge valve in the snorkel conduit at a location approximately midway between the mouthpiece and the open end of the snorkel conduit.

At mid-length of the snorkel conduit, the purge valve will be close to the ambient water surface when the skin diver is swimming face down on the water surface. At such a location, the purge valve will drain that portion of the snorkel conduit that extends above the purge valve and the water surface, but will not initially interfere with the purging blast of air. Even at this location, the purge valve will dissipate the forcefully exhaled air and the amount of residual water adhering to the inside surface of the conduit between the purge valve and the open end will be substantial. Residual water subsequently accumulates at the lowermost portion of the snorkel conduit and obstructs the conduit. Consequently, a single purge valve, even when located mid-length of the snorkel conduit, is of limited benefit.

The applicant addressed the problems of the prior art by the teachings of U.S. Pat. No. 4,879,995 titled Snorkel for Skin Divers, filed Oct. 13, 1987 and issued Nov. 14, 1989; and continuation U.S. Pat. No. 5,092,324 titled Snorkel for Skin Divers, filed Oct. 12, 1989 and issued Mar. 3, 1992. The applicant's patents teach a conduit divided approximately mid-length by a bell-shaped chamber having a symmetrical purge valve. The purge valve is located adjacent and above the water surface when the snorkel is in use by a skin diver swimming face down on the water surface. The purge valve opens under slight hydrostatic pressure and quickly drains water from the upper portion of the conduit when the skin diver returns to the surface after swimming or diving underwater. After a purging exhalation, or after splashing into the open end of the upper conduit due to swimming movements or wave action or-the-like, the forces of molecular cohesion and adhesion cause water to flow down the inside surface of the upper conduit and chamber to the purge valve. The purge valve opens under slight hydrostatic pressure and drains the water to ambient at a rate sufficient to prevent overflow into the lower conduit. Drainage of the lower conduit is facilitated by an optional second purge valve located at the bottom of a second chamber below the mouthpiece. The lower portion of the conduit is purged for respiration by exhaling a forceful blast of air into the mouthpiece that pushes the water upward. The effort required to purge the snorkel is reduced because the bulk of the ascending water flows out the first purge valve, without the need to overflow the snorkel top. The chamber located below the mouthpiece captures residual water in the snorkel after a purging exhalation and any water that overflows the first purge valve. The second chamber also captures fluids that may drain from the swimmers mouth through the mouthpiece.

Snorkels based on the teachings of U.S. Pat. Nos. 4,879,995 and 5,092,324 have been successfully marketed to the diving and swimming community under the trade name "Impulse Snorkel". However, swimmers have complained that the size and bulk of the Impulse Snorkel's mid-length bell-shaped chamber causes excessive drag when moving through the water, this problem is solved by the instant invention.

SUMMARY OF THE INVENTION

The instant invention incorporates an asymmetrical purge valve tilted to fit within the confines of a chamber having a substantially elliptical cross-section. The elliptical cross-section is oriented to minimize the frontal area presented in the direction of swimming movement. The reduced frontal area results in a corresponding reduction of drag when the diver is swimming underwater.

DESCRIPTION OF THE DRAWINGS

A detailed description of the invention is made with reference to the accompanying drawings wherein like numerals designate corresponding parts in the several FIGS.

FIG. 1 is a side sectional view of a snorkel having an upper purge valve that has been constructed in accordance with the principles of the instant invention.

FIG. 2 is a cross-sectional view taken in the direction 2-2 of FIG. 1.

FIG. 3 is a cross-sectional view taken in the direction 3-3 of FIG. 1.

FIG. 4 is an exploded partial view of the several components incorporated into the snorkel of FIG. 1.

DESCRIPTION OF THE PREFERRED EMBODIMENT

Figure 5:
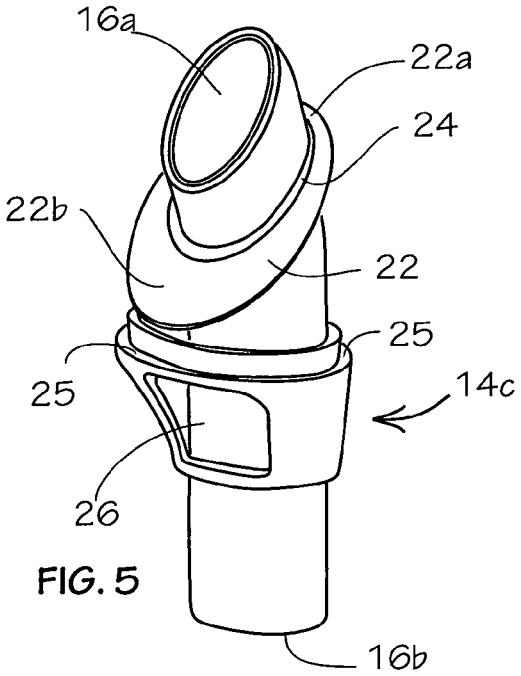
FIG. 5 is an oblique view showing only the purge valve and the snorkel component that carries it.

The following detailed description is of the best presently contemplated modes of carrying out the invention. This description is not to be taken in a limiting sense, but is made merely for purposes of illustrating the general principles of the invention.

Referring to FIG. 1, the inventive snorkel is pictured in the approximate position of use by a diver swimming face down on water surface 12. (For clarity, the diver is not shown in the FIGS.) The words "upper" and "lower" or "above the water surface" and "below the water surface," or the like, are made with reference to the orientation of the snorkel as shown in FIG. 1.

The inventive snorkel includes conduit 14 whose length is divided into upper conduit 14*a* and lower conduit 14*b* by a bulge located at approximately mid-length. The bulge forms a chamber that houses purge valve 22. Purge valve 22 opens to ambient through side opening 26. Side opening 26 is advantageously located above water surface 12 when a swimmer is breathing through the inventive snorkel.

Upper conduit 14*a* extends into the air above water surface 12 and has an end with ambient opening 18. Opening 18 is advantageously unobstructed and located in-line with the conduit's longitudinal axis, thereby providing a substantially unrestricted respiratory flow path to ambient.

Lower conduit 14*b* extends underwater and has an end closed by purge valve 30. Purge valve 30 is arranged to allow fluid, for example water or saliva, to flow freely from conduit 14*b* to ambient.

Purge valves 22 and 30 are, typically, a thin flexible diaphragm of a resilient material, for example silicon elastomer or the like, which is mounted in such a way that it can selectively flex under slight pressure to allow flow in one direction only. Reverse pressure forces the diaphragm to seal closed. Consequently, purge valves 22 and 30 prevent the reverse flow of water from ambient into conduit 14.

Mouthpiece 40, above purge valve 30, branches from the side of conduit 20. Mouthpiece 40 is adapted to be held by the mouth of the diver and provides a flow path from conduit 14 to the interior of the mouth. (In the FIGS., the opening of mouthpiece 40 should be considered covered by the diver's mouth.) Although the preferred configuration includes purge valve 30, the instant invention can be incorporated on snorkels that do not include purge valve 30 by terminating the underwater end of conduit 14*b* at mouthpiece 40.

Conduit 14 is constructed of a rigid or semi-rigid material, for example, acrylic or vinyl plastic or the like. Conduit 14 is best configured to approximately follow the curvature of the diver's head. The upper portion of conduit 14 smoothly curves to place upper opening 18 approximately over the center of the head.

Providing a substantially smooth flow path that is free of abrupt changes in path direction facilitates respiration and purging. While not so limited, the curvature of conduit 14 may, for example, follow an elliptical path adjacent the side of the swimmer's head. Alternately, the upper portion of conduit 14 can be straight.

When a diver swims or dives below the water surface, water will pour into the snorkel through opening 18, flooding the snorkel. As the diver surfaces and assumes the face down, surface swimming stance, water in the snorkel above ambient water surface 12 will drain through purge valves 22 and 30.

Water and saliva remaining in lower conduit 14*b* are purged by forcefully exhaling air into mouthpiece 40. Surface tension forms the exhaled air into a bubble that expands upward in conduit 14*b*. As the leading surface of the bubble moves away from mouthpiece 40, the bulk of the water within conduit 14 is pushed ahead of the bubble toward and out opening 18. Furthermore, as water in the snorkel is lifted above ambient water surface 12 by the purging bubble of air, the water will also flow to ambient through opening 26. This purging action is facilitated by the instant invention because conduit 14 provides a substantially smooth and unimpeded flow path.

When optional purge valve 30 is provided, a forceful exhalation will also expand downward, forcing fluid below mouthpiece 40 to flow to ambient through purge valve 30. The outflow of water will flex purge valve 30 outward. Consequently, a purging exhalation forces water within conduit 14 to be cleared both above and below mouthpiece 40.

Figure 8:
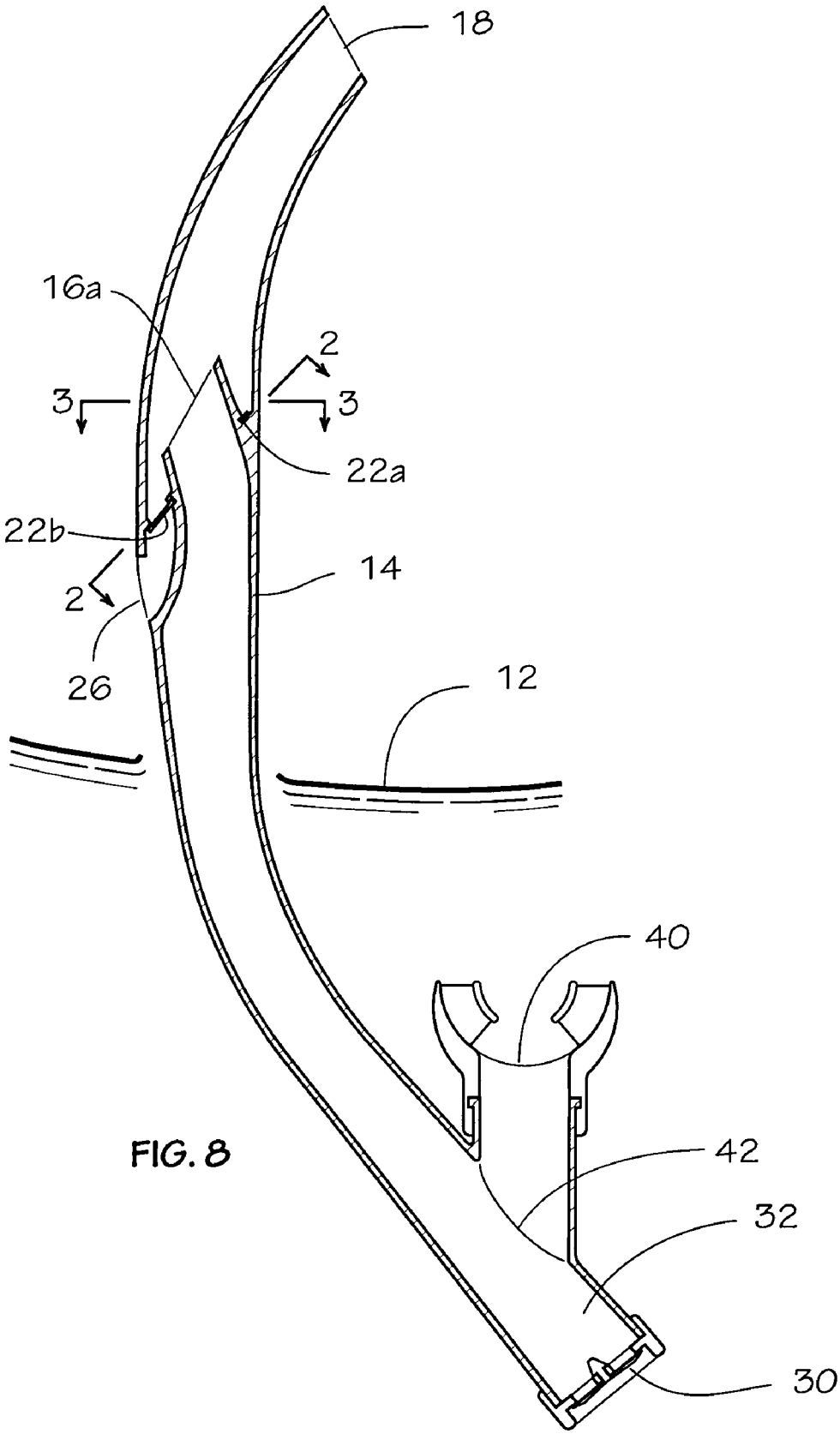
FIG. 8 is a cross-sectional view of a snorkel similar to FIG. 1 constructed with a single-piece conduit.

As illustrated by FIG. 8, conceivably conduit 14 can be fabricated as a single piece in which purge valve 22 and related components are inserted through one of the conduit ends, However as illustrated by FIG. 1, fabrication is facilitated by dividing conduit 14 into several parts. For example, conduit 14 can be advantageously divided into three parts: upper conduit 14*a*, lower conduit 14*b*, and coupler 14*c*.

Upper conduit 14*a* extends above the water surface. Lower conduit 14*b* extends below the water surface. Coupler 14*c* holds purge valve 22, provides side-opening 26, and joins upper conduit 14*a* to lower conduit 14*b*. Opening 16*b* of coupler 14*c* is configured to smoothly join with the interior of lower conduit 14*b*.

Figure 9:
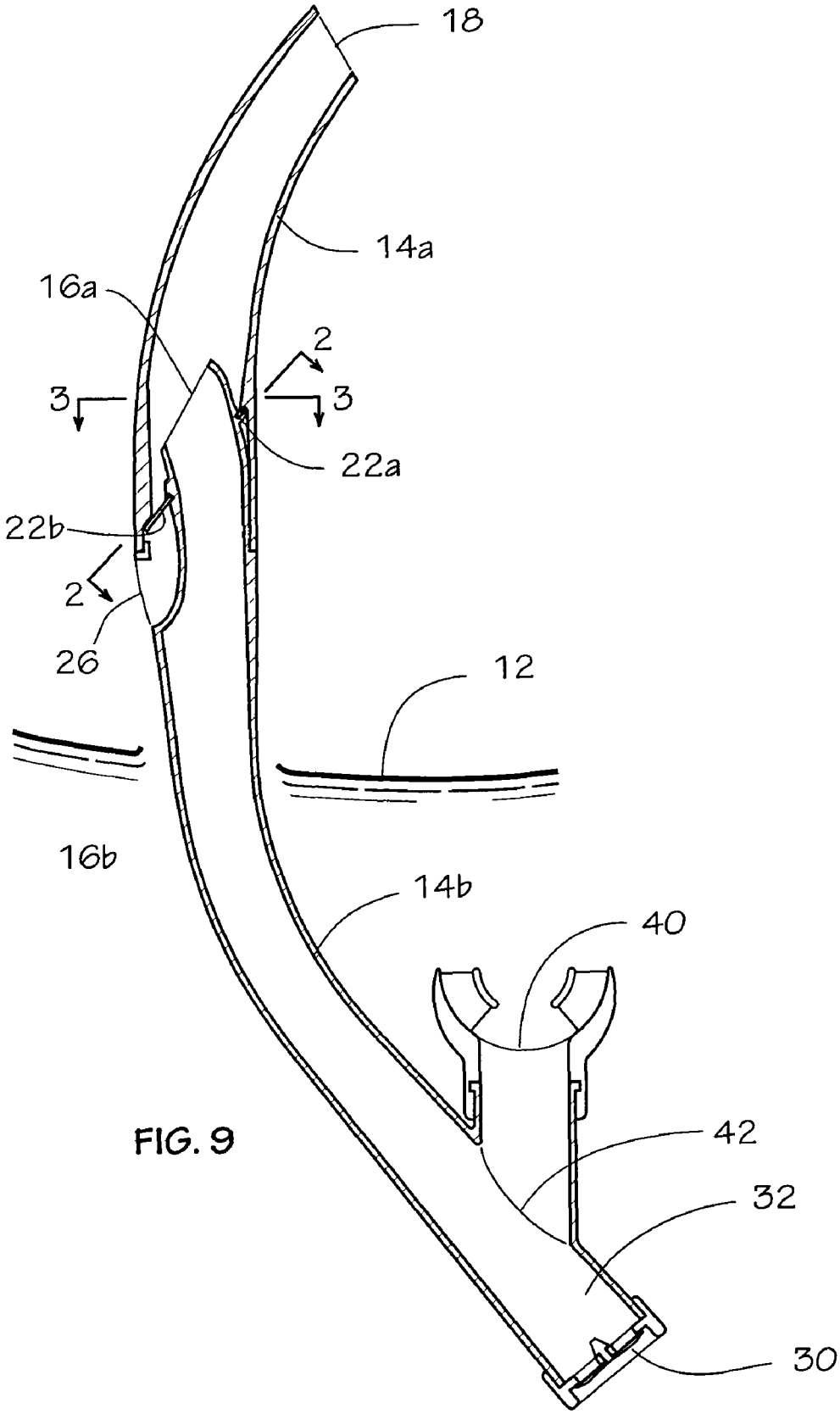
FIG. 9 is a cross-sectional view of a snorkel similar to FIG. 1 constructed with a conduit having an upper part and a lower part.

As illustrated by FIG. 9, a two-part arrangement can be also be used in which the top of lower conduit 14*b* holds purge valve 22, provides side-opening 26 and joins directly the bottom of upper conduit 14*a*.

Opening 16*a* (see FIG. 1) resides within the lower portion of upper conduit 14*a*. The cross-section of the lower portion of upper conduit 14*a* gradually expands to form a bulge or chamber so that space is provided around opening 16*a* to enable water in upper conduit 14 to easily reach and flow to ambient through purge valve 22 and side opening 26. When assembled, the lower edge of upper conduit 14*a* forms a watertight seal with ledge 25 (see FIG. 4).

Although not so limited, conduits 14*a* and 14*b* have substantially the same cross-section, for example circular or elliptical. Reducing the frontal area presented in the direction of swimming movement minimizes snorkel drag. Consequently, the chamber surrounding purge valve 22 is configured to have a substantially elliptical cross-section, and the chamber is orienting so that the ellipse minor axis faces the direction of travel, Furthermore, a substantially elliptical cross-section adjacent purge valve 22 enables the inventive snorkel to be routed relatively close to the head, also resulting in lower swimming drag.

The transition from the inside cross-section of upper conduit 14*a* to the larger substantially elliptical inside cross-section adjacent side opening 26 is gradual, smooth and without break. Therefore, the inside surface contour is uniform and without abrupt changes in the direction of fluid flow.

Purge valve 22 is located adjacent and above side opening 26. Purge valve 22 is oriented and mounted in such a way that the lower unrestrained edge can selectively flex under slight pressure to allow flow in one direction only. Reverse pressure forces purge valve 22 to seal closed against shelf 20. Consequently, purge valve 22 will allow flow to ambient, but prevents the flow of water from ambient into conduit 14.

As best seen in FIG. 2, the outer edge of purge valve 22 is circular. A portion of purge valve 22 is cutout by circular opening 23. Circular opening 23 is offset from the center of purge valve 22 thereby giving purge valve 22 an asymmetrical shape having a narrow portion 22*a* and a wide portion 22*b*.

Circular opening 23 is mounted in circular groove 24 (see FIG. 4) so that wide portion 22*b* is adjacent and above opening 26. The mounting is configured with sufficient clearance to enable diaphragm 22 to flex as needed to make a watertight seal against shelf 20.

As best seen in FIG. 3, tilting groove 24, and thereby purge valve 22, with respect to the longitudinal axis of conduit 14 accommodates the elliptical cross-section of conduit 14 adjacent opening 26. As described supra, having a substantially elliptical cross-section adjacent diaphragm 22 and opening 26 provides a smaller frontal area in the direction of swimming movement, and close mounting to the swimmer's head, both of which reduces swimming drag. Furthermore, tilting groove 24 so that portion 22*b* of purge valve 22 is lower than portion 22*a* facilitates the guidance of water toward opening 26.

The purging bubble of air will clip past water which adheres to the inside surfaces of conduits 14*a* and 14*b*. In general, very little water will remain on the inside surface of lower conduit 14*b* because the initial driving pressure within the bubble close to mouthpiece 40 is significantly higher than ambient.

Figure 6:
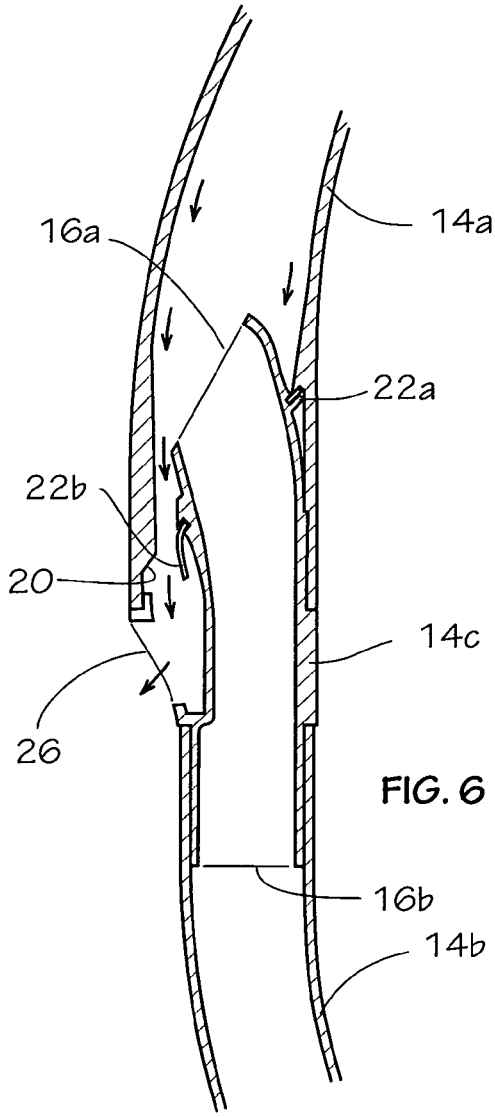
FIG. 6 is a close-up side view of the snorkel of FIG. 1 showing the purge valve open.

Referring to FIG. 6, after the purging air bubble is spent, the forces of molecular cohesion and adhesion cause residual water to flow (depicted as arrows in FIG. 6) down the inside surface of conduit 14*a*, around opening 16*a* to the unrestrained portion 22*b* of purge valve 22. Similarly, water which splashes into opening 18 due to swimming movements or wave action will strike and adhere to the inside surface of upper conduit 14*a* and thereafter flow directly to the unrestrained portion 22*b* of purge valve 22.

The gradual transition from the inside cross section of upper conduit 14*a* to the larger substantially elliptical inside cross section adjacent purge valve 22 is smooth and uninterrupted so that the forces of cohesion and adhesion maintain a substantially sheet like flow of water which will not break away from the inside surface. Similarly, the forces of molecular cohesion and adhesion cause water to follow the inside surface of the curve of upper conduit 14*a*.

Water will flow down the inside wall of conduit 14*a* directly to the unrestrained outside edge of purge valve 22. Slight hydrostatic pressure will flex unrestrained portion 22*b* of purge valve 22 away from shelf 20 and drain water to ambient at a rate sufficient to prevent overflow into lower conduit 14*b*. Providing portion 22*b* of purge valve 22 with a sufficient area facilitates rapid drainage of water.

Water cannot flow through portion 22*a* of purge valve 22 because portion 22*a* is restrained between groove 24 and shelf 20 (see FIG. 6). Portion 22*a* of purge valve 22 serves to properly locate and maintain the position of portion 22*b* with respect to opening 26. The asymmetrical aspect of purge valve 22 allows fluid flow only past the widest portion 22*b*.

Fabricating purge valve 22 with an elliptical circumference and a centrally located cutout for mounting does not provide sufficient diaphragm flexibility to reliably function as a purge valve. The asymmetrical design of the instant invention provides the necessary flexibility.

Upper conduit 14*a* is drained by purge valve 22 when water develops hydrostatic head by being above ambient water surface 12. Purge valve 22 is advantageously located approximately mid-distance between mouthpiece 40 and opening 18. At approximately mid-distance between mouthpiece 40 and opening 18, purge valve 22 will normally be above ambient water surface 12 when the user is swimming face down on the water surface and, consequently, purge valve 22 will continuously drain any water that flows or splashes into conduit 14*a*.

Figure 7:
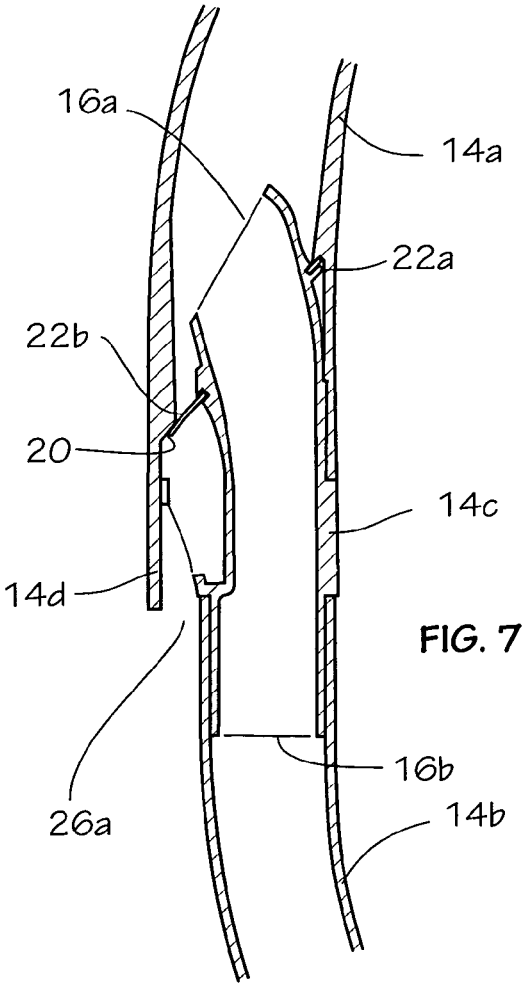
FIG. 7 is a close-up side view of an alternate configuration showing the purge valve closed.

FIG. 7 illustrates an addition to the instant invention in which hood-like projection 14*d* of conduit 14 covers and protects the ambient opening for purge valve 22. Opening 26*a* has the same function as opening 26.

It is understood that those skilled in the art may conceive of modifications and/or changes to the invention described above. Any such modifications or changes that fall within the purview of the description are intended to be included therein as well. This description is intended to be illustrative and is not intended to be limiting. The scope of the invention is limited only by the scope of the claims appended hereto.

I claim:

1. A snorkel device for use on the water surface, said snorkel device comprising:

conduit having a first end, second end, cross-section, and longitudinal axis;

said conduit first end open to ambient above the water surface;

mouthpiece adjacent said conduit second end and joined to communicate fluid flow with the interior of said conduit;

said conduit having at least one intermediate ambient opening between said first end and said mouthpiece;

purge means within and extending entirely across said conduit and adjacent said intermediate ambient opening; said purge means selectively provides unidirectional fluid flow to ambient from said conduit through said intermediate ambient opening; and said purge means tilted relative said longitudinal axis to minimize the cross-section of said conduit.

2. The snorkel device recited in claim 1 wherein:

said conduit has at least one lower ambient opening located below said mouthpiece; and second purge means adjacent said conduit lower ambient opening selectively provides unidirectional fluid flow to ambient from said conduit through said lower ambient opening.

3. The snorkel device recited in claim 1 wherein:
said intermediate ambient opening is located adjacent and generally above the water surface.

4. The snorkel device recited in claim 1 wherein:
said intermediate ambient opening has a protective covering.

5. The snorkel device recited in claim 1 wherein:
said purge means is an asymmetrical diaphragm.

6. The diaphragm recited in claim 5 wherein:
said diaphragm has a substantially circular circumference with a substantially circular cutout offset from the center of said circular circumference.

7. The snorkel device recited in claim 1 wherein:
a portion of said conduit adjacent said purge means expands thereby forming a bulge in said conduit, said bulge having a substantially elliptical cross-section that accommodates said tilted purge means.

8. The snorkel device recited in claim 7 wherein:
said portion of said conduit expands such that the forces of cohesion and adhesion cause water to flow down the inner surface of said conduit to said tilted purge means.

9. The snorkel device recited in claim 1 wherein:
said conduit between said first end and said second end is at least one piece.

10. The snorkel device recited in claim 1 wherein:
said conduit has an upper part and a lower part joined by a coupling part.

11. The snorkel device recited in claim 1 wherein:
said conduit has an upper part and a lower part joined together.

12. A snorkel device comprising:
a conduit having a first end and a second end;
said conduit first end is open, unobstructed and freely passes fluid;
mouthpiece adjacent said conduit second end and joined to communicate fluid flow with the interior of said conduit;
said conduit having at least one ambient opening located adjacent and generally above the water surface when said snorkel device is used by a diver swimming face down on the water surface;
a portion of said conduit adjacent said ambient opening expands to form a chamber having a substantially elliptical cross-section;
purge means within said chamber selectively providing unidirectional fluid flow to ambient from said conduit through said ambient opening; and
said purge means tilted to fit within the confines of said chamber.

13. The snorkel device recited in claim 12 wherein:
said portion of said conduit expands such that the forces of cohesion and adhesion cause water to flow down the inner surface of said conduit to said purge means.

14. A snorkel device supported by a swimmer on the water surface comprising:
first conduit adapted to extend above the water surface, having an open top and a bottom end;
a portion of said first conduit adjacent its bottom end expands thereby forming a chamber that has flared sides with a substantially elliptical cross-section;
second conduit adapted to extend below the water surface, having top and bottom ends;
mouthpiece adjacent said second conduit bottom end joined to communicate fluid flow with the interior of said second conduit;
coupling means joining said first conduit bottom end to said second conduit top end, said coupling means having at least one opening to ambient;
said coupling means communicating fluid flow between the interiors of said first and second conduits and said opening to ambient;
purge means adjacent said coupling means opening to ambient, said purge means selectively providing unidirectional flow to ambient from said first and second conduits through said opening; and
said purge means mounted at an angle to accommodate placement within the substantially elliptical cross-section of said first conduit bottom end.

15. The snorkel device recited in claim 14 wherein:
said coupling means is located adjacent and generally above the water surface.

16. The snorkel device recited in claim 14 wherein:
said purge means is an a symmetrical diaphragm having a substantially circular circumference with a substantially circular cutout offset from the center of said circular circumference.

17. The snorkel device recited in claim 14 wherein:
said opening to ambient has a protective covering.

* * * * *